US006994062B2

(12) United States Patent
Kawai et al.

(10) Patent No.: US 6,994,062 B2
(45) Date of Patent: Feb. 7, 2006

(54) VARIABLE VALVE TIMING CONTROL DEVICE

(75) Inventors: Yoshiyuki Kawai, Toyota (JP); Masaki Kobayashi, Toyota (JP); Shinji Ohe, Toyota (JP); Hideyuki Suganuma, Toyota (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 10/876,588

(22) Filed: Jun. 28, 2004

(65) Prior Publication Data

US 2005/0022764 A1 Feb. 3, 2005

(30) Foreign Application Priority Data

Jun. 27, 2003 (JP) ..... 2003-185603

(51) Int. Cl.
*F01L 1/34* (2006.01)

(52) U.S. Cl. ..... 123/90.15; 123/90.17; 123/90.31; 464/160

(58) Field of Classification Search ..... 123/90.15, 123/90.16, 90.17, 90.18, 90.27, 90.31, 406.58, 123/406.62; 464/1, 2, 160; 73/116, 117.3, 73/118.1; 92/120, 121, 122, 123, 124, 125, 92/126, 5 R See application file for complete search history.

(56) References Cited

U.S. PATENT DOCUMENTS

| | | | | |
|---|---|---|---|---|
| 5,715,780 | A * | 2/1998 | Haller | 123/90.17 |
| 6,609,498 | B2 * | 8/2003 | Mathews et al. | 123/406.62 |
| 6,729,280 | B2 * | 5/2004 | Muraki | 123/90.15 |
| 6,827,052 | B2 * | 12/2004 | Kobayashi et al. | 123/90.17 |
| 2002/0062802 | A1 | 5/2002 | Saito et al. | |
| 2003/0221647 | A1 | 12/2003 | Kobayashi et al. | |

FOREIGN PATENT DOCUMENTS

| | | |
|---|---|---|
| JP | 2002-227622 | 8/2002 |

* cited by examiner

*Primary Examiner*—Thomas Denion
*Assistant Examiner*—Ching Chang
(74) *Attorney, Agent, or Firm*—Buchanan Ingersoll PC

(57) ABSTRACT

A variable valve timing control device includes a rotor member integrally connected to either one of a camshaft and a crankshaft, a housing member connected to either one of the crankshaft and the camshaft via a driving force transmitting member and assembled to the rotor member so as to be rotatable relative thereto, a vane, a fluid pressure chamber divided into an advanced angle chamber and a retarded angle chamber by the vane, and a sensor wheel assembled to either one of the rotor member and the housing member and including a projecting portion for detecting a rotational angle of the rotor member or the housing member by using a sensor provided adjacent to the sensor wheel. The sensor wheel includes at least one reference hole for determining a position of the projecting portion in a circumferential direction of the sensor wheel.

6 Claims, 5 Drawing Sheets

VARIABLE VALVE TIMING CONTROL DEVICE

CROSS REFERENCE TO RELATED APPLICATIONS

This application is based on and claims priority under 35 U.S.C. § 119 to Japanese Patent Application 2003-185603, filed on Jun. 27, 2003, the entire content of which is incorporated herein by reference.

FIELD OF THE INVENTION

This invention generally relates to a variable valve timing control device. More particularly, the present invention pertains to a variable valve timing control device for controlling an opening and closing timing of an intake valve and exhaust valve of an internal combustion engine.

BACKGROUND

A known variable valve timing control device is disclosed in Japanese Patent Laid-Open Publication No. 2002-227622. The disclosed variable valve timing control device includes a rotor member integrally connected to a camshaft for opening and closing a valve that is rotatably assembled to a cylinder head of an internal combustion engine, and a housing member connected to a crankshaft via a driving force transmitting member and being rotatable relative to the rotor member. The variable valve timing control device also includes vanes each assembled to one of the rotor member and the housing member, fluid chambers each formed between the rotor member and the housing member and divided into an advanced angle chamber and a retarded angle chamber by the vane, and a target plate (sensor wheel) assembled to at least one of the rotor member and the housing member and includes projecting portions for detecting a rotational angle of the rotor member or the housing member by using a sensor provided in the vicinity of the target plate.

According to the above disclosed variable valve timing control device, the rotor member is rotated relative to the housing member by an fluid pressure selectively supplied to or discharged from the advanced angle chamber or the retarded angle chamber for changing the opening and closing timing of an intake valve or an exhaust vale. In addition, the rotational angle of the target plate, i.e. the rotational angle of the camshaft, is detected by a sensor such as an electromagnetic pick-up provided in the vicinity of the projecting portions of the target plate.

In addition, according to the above disclosed variable valve timing control device, when the target plate is press fit to a boss portion of the rotor member, each position of the target plate and the rotor member in the circumferential direction thereof is determined beforehand. At this time, the position of the target plate in the circumferential direction is determined by utilizing the projecting portions of the target plate and then the target plate is press fit to the rotor member. In case of determining the position of the target plate in the circumferential direction by using the projecting portions thereof, a fixing jig for the target plate may have a complicated structure and thus be expensive for assuring the accuracy if a shape of the projecting portion is complicated. In addition, the projecting portion of the target plate may interfere with the fixing jig, thereby causing the deformation of the projecting portion.

Further, according to the disclosed variable valve timing control device, the press fit amount of the target plate to the rotor member is required to be controlled for assuring an appropriate distance between the target plate and the sensor. Thus, an expensive facility for press fit may be required for controlling the press fit amount of the target plate.

Furthermore, according to the disclosed variable valve timing control device, in order to assure a press fit length of an extending portion of the target plate into the rotor member, a thickness of the extending portion in the axial direction is defined larger than that of the projecting portion of the target plate. In this case, a length of the device is increased in the axial direction to thereby avoid the extending portion of the target plate being press fit to the rotor member from interfering with the housing member provided adjacent to the target plate.

Furthermore, a face of the projecting portion of the target plate that faces the sensor may have an inferior detection performance due to shear droop caused by a press molding. Therefore, a wrong detection may occur.

Thus, a need exists for a variable valve timing control device wherein a sensor wheel for detecting a relative rotational phase between a rotor member integrally connected to a camshaft and a crankshaft can be fixed to a rotor member with an accurate relative position relationship therewith at a low cost.

SUMMARY OF THE INVENTION

According to an aspect of the present invention, a variable valve timing control device includes a rotor member integrally connected to either one of a camshaft and a crankshaft for opening and closing a valve, either one of the camshaft and the crankshaft being rotatably assembled to a cylinder head of an internal combustion engine, a housing member connected to either one of the crankshaft and the camshaft via a driving force transmitting member and assembled to the rotor member so as to be rotatable relative thereto, and a vane provided on either one of the rotor member and the housing member. The variable valve timing control device also includes a fluid pressure chamber formed between the rotor member and the housing member and divided into an advanced angle chamber and a retarded angle chamber by the vane and a sensor wheel assembled to either one of the rotor member and the housing member, and including a projecting portion for detecting a rotational angle of the rotor member or the housing member by using a sensor provided adjacent to the sensor wheel. The sensor wheel includes at least one reference hole for determining a position of the projecting portion in a circumferential direction of the sensor wheel.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
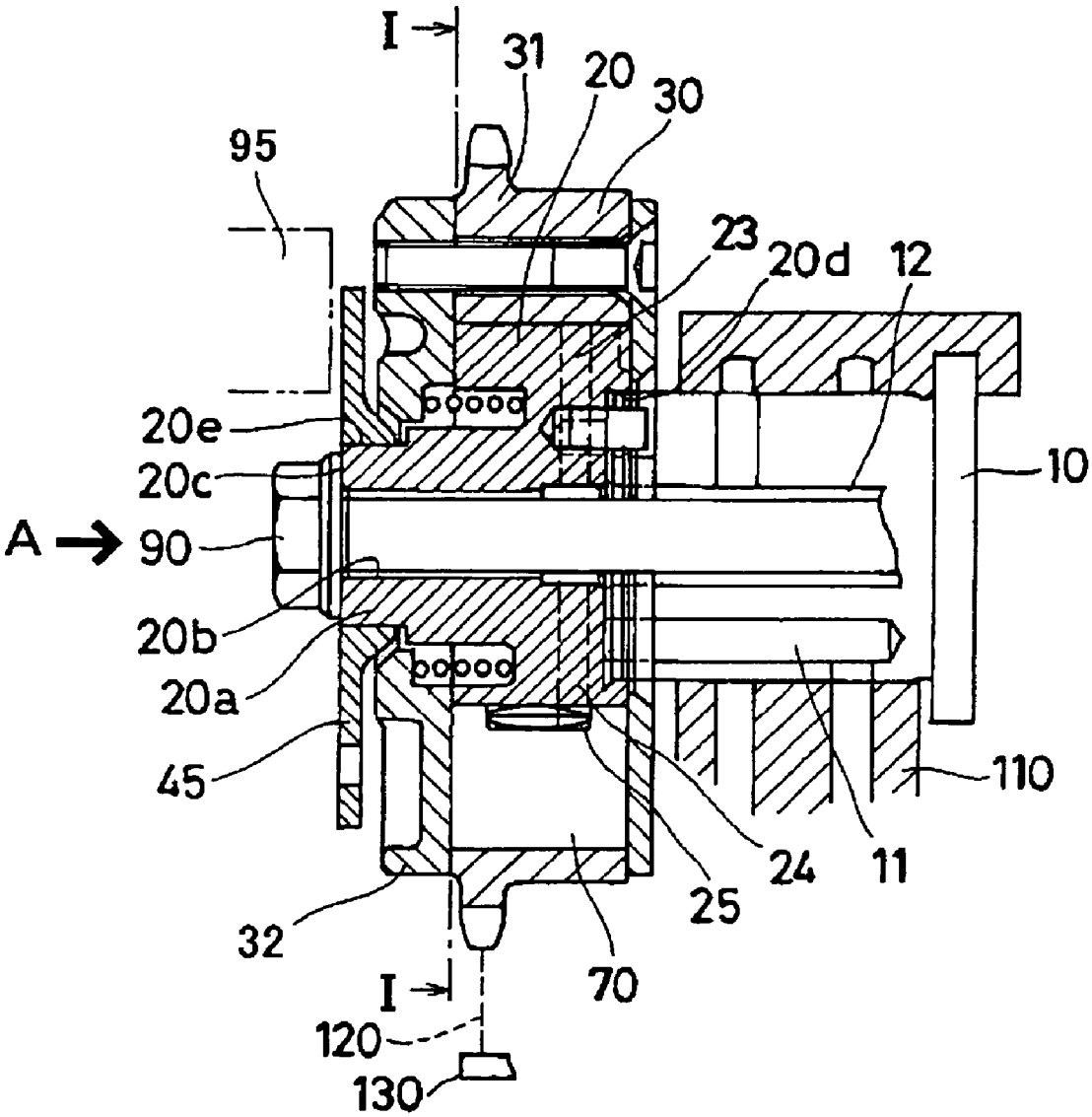
FIG. 1 is a longitudinal sectional view of a variable valve timing control device according to an embodiment of the present invention.

An embodiment of the present invention is explained referring to attached drawings.

A variable valve timing control device shown in FIGS. 1 to 5 includes a rotor 20 (rotor member) integrally fixed to a tip end portion of a camshaft 10 being rotatably supported on a cylinder head 110 of an internal combustion engine, and a housing 30 (housing member) connected to a crankshaft 130 via a timing chain 120 (drive force transmitting member) and assembled to an outer periphery of the rotor 20, being rotatable relative to the rotor 20 within a predetermined range. A timing sprocket 31 is integrally formed on an outer periphery of the housing 30. The variable valve timing control device also includes four vanes 70 assembled to the rotor 20. An advanced angle fluid passage 11 and a retarded angle fluid passage 12 through which an operation fluid is supplied to or discharged from an advanced angle chamber R1 and a retarded angle chamber R2 (to be mentioned later) are formed on the camshaft 10, extending in the axial direction thereof. The timing sprocket 31 receives a rotation force from the crankshaft 130 via a crank sprocket (not shown) and the timing chain 120. According to a structure of the present embodiment, the rotation force of the crankshaft 130 of the internal combustion engine is transmitted to the timing sprocket 31 of the housing 30. However, the embodiment is not limited to the above structure. For example, a belt member instead of the timing chain 120 and a pulley instead of the timing sprocket 31 may be employed.

The rotor 20 having a stepped cylindrical shape includes a boss portion 20*a* and a penetrating bore 20*b* at a center in the axial direction of the rotor 20. The rotor 20 also includes a concave portion 20*d* at an end face to which the camshaft 10 is assembled. The camshaft 10 is located in the concave portion 20*d*. A single installation bolt 90 is in contact with a seating face 20*c* formed on an end face of the boss portion 20*a* with passing through the penetrating bore 20*b* and fastened to the camshaft 10 for fixing the rotor 20. A sensor wheel 45 for detecting a rotational angle of the camshaft 10 is press fit to an outer periphery 20*e* of the boss portion 20*a*.

Figure 3:
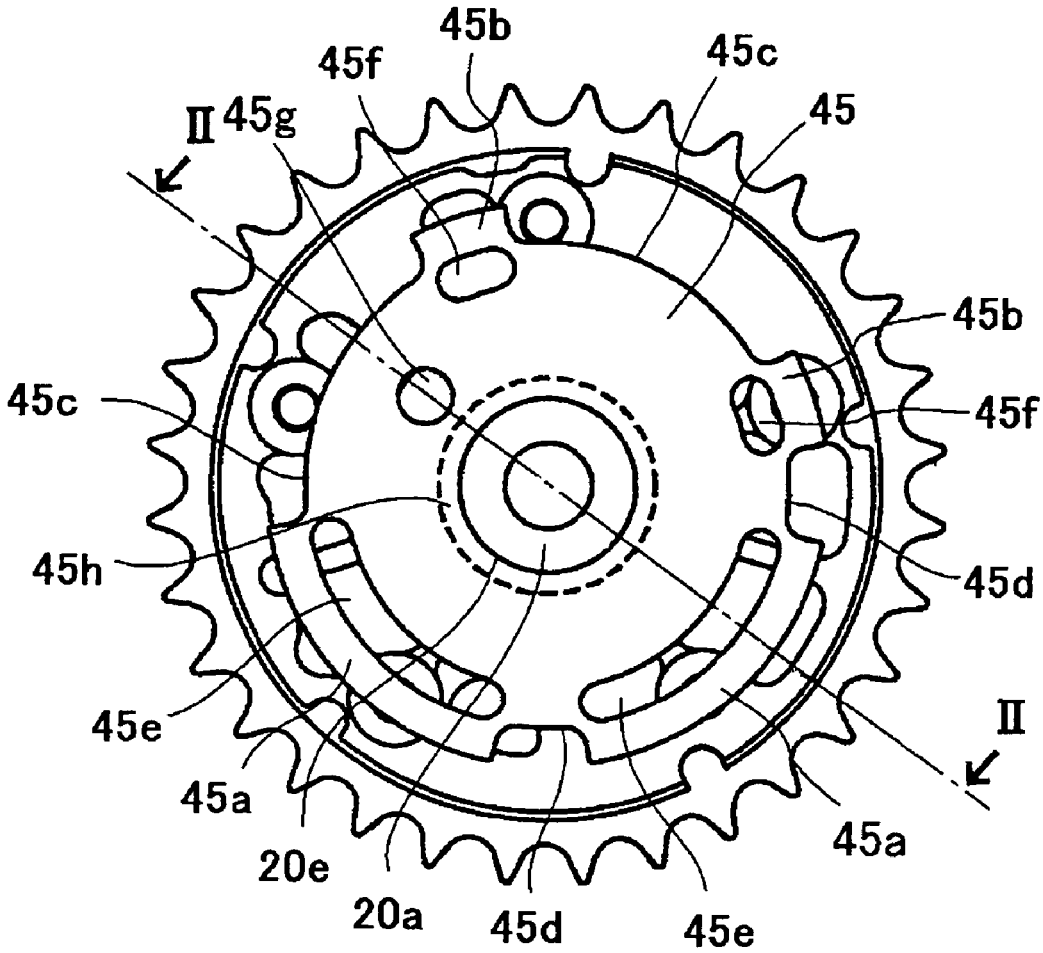
FIG. 3 is a front view viewed from an arrow A of FIG. 1.

As shown in FIG. 3, the sensor wheel 45 having a substantially circular disk shape includes two projecting portions 45*a* extending in the circumferential direction of the sensor wheel 45, and two projecting portions 45*b* whose length in the circumferential direction is shorter than that of the projecting portions 45*a*. The projecting portions 45*a* and 45*b* are provided for detecting a rotational angle of the rotor 20 and formed on the outer circumference of the sensor wheel 45. Respective grooves 45*c* and 45*d* are formed between the projecting portions 45*a* and 45*b* as shown in FIG. 3. In addition, elongated holes 45*e* and 45*f* are formed on the sensor wheel 45 in the radially inward direction relative to the projecting portions 45*a* and 45*b* so as to extend in the circumferential direction of the sensor wheel 45. A sensor 95 (shown in FIG. 1) for detecting the rotational angle of the rotor 20 is provided at an engine side, facing to the projecting portions 45*a*, 45*b* and the elongated holes 45*e* and 45*f* with keeping a predetermined distance with the sensor wheel 45. In addition, a reference hole 45*g* having a circular shape is formed on the sensor wheel 45 in the radially inward direction relative to the elongated holes 45*e* and 45*f*. When the sensor wheel 45 is press fit to the boss portion 20*a* of the rotor 20, a fixing jig (not shown) is inserted into the reference hole 45*g* for determining the position of the sensor wheel 45 in the circumferential direction. Thus, the deformation of the projecting portions 45*a* and 45*b* may be avoided. In addition, moment of inertia may be reduced by forming the reference hole 45*g* on the sensor wheel 45, thereby preventing a rotational displacement of the sensor wheel 45 relative to the rotor 20 due to the fluctuation torque of the cam and the like. The reference hole 45*g* may have an elongated shape, an oval shape, or the like. In addition, a plurality of the reference holes 45*g* may be formed on the sensor wheel 45.

Figure 4:
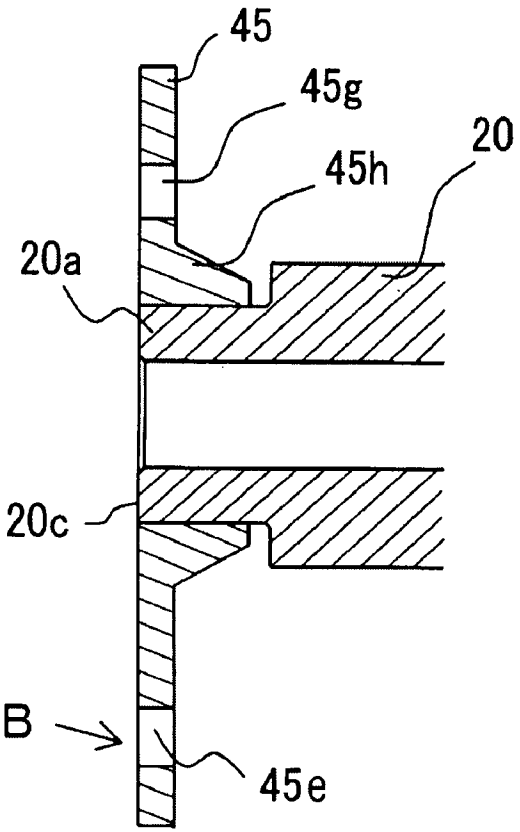
FIG. 4 is a longitudinal sectional view of press fit portions of a sensor wheel and a boss portion respectively taken along the line II—II of FIG. 3.
Figure 6:
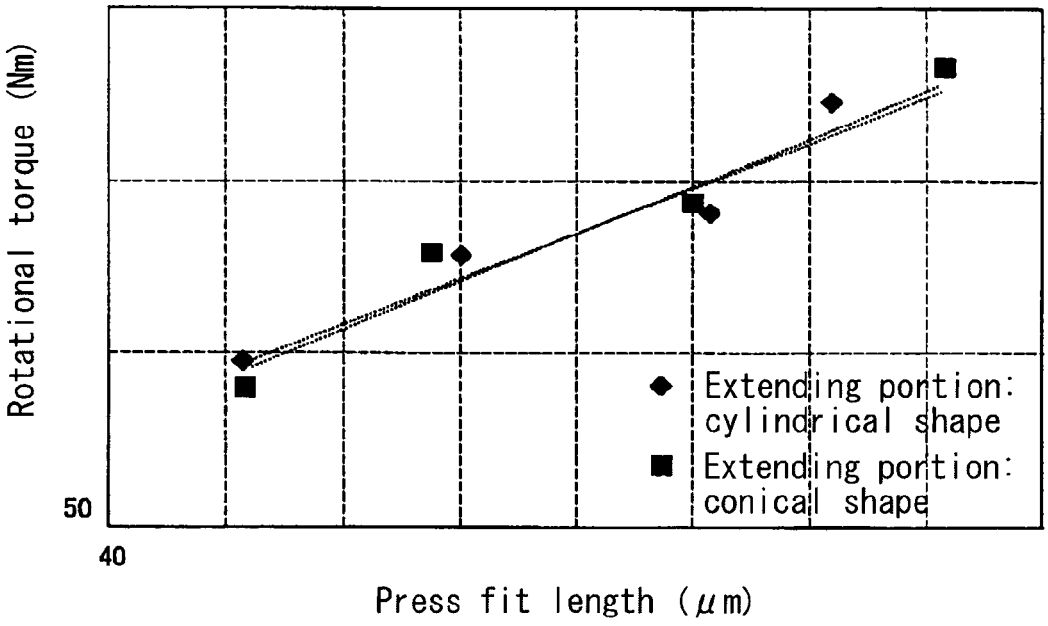
FIG. 6 is a graph of a relationship between rotational torque and press fit length for extending portions of cylindrical and conical shapes.

As shown in FIG. 4, an extending portion 45*h* of the sensor wheel 45 is press fit to the boss portion 20*a* of the rotor 20. An axial end face of the extending portion 45*h* (left side in FIG. 4) and an axial end face of the boss portion 20*a* (left side in FIG. 4) are positioned on an identical plane. Thus, the sensor wheel 45 is press fit to the boss portion 20*a* of the rotor 20 until the axial end face of the boss portion 20*a* becomes in contact with a face of the fixing jig positioned on the identical plane to that of the extending portion 45*h* or the boss portion 20*a*. As a result, the press fit amount of the sensor wheel 45 to the boss portion 20*a* may be easily controlled to thereby appropriately assure a distance between the sensor wheel 45 and the sensor 95. The axial end face of the boss portion 20*a* is equal to the seating face 20*c* in contact with the bolt 90. In addition, the extending portion 45*h* of the sensor wheel 45 press fit to the boss portion 20*a* has a conical shape whose outer circumference is gradually reduced in a direction in which the sensor wheel 45 is extending. Therefore, the sensor wheel 45 is prevented from interfering with an inner radial portion of a front plate 32 (housing member) arranged adjacent to the sensor wheel 45. In addition, an axial length of the variable valve timing control device may be reduced to thereby achieve a downsizing of the device. As shown in FIG. 6, the extending portion 45*h* with the conical shape assures the same level of press fit length as in the case of a cylindrical shape being employed for the extending portion 45*h*. That is, a rotational torque at which a displacement is caused between press fit portions of the sensor wheel 45 and the boss portion 20*a* (i.e. the sensor wheel 45 and the boss portion 20*a* starts rotating relative to each other) may be the same level as in the case of the cylindrical shape being employed for the extending portion 45*h*. Thus, the rotational displacement between the sensor wheel 45 and the rotor 20 may be prevented.

Figure 5:
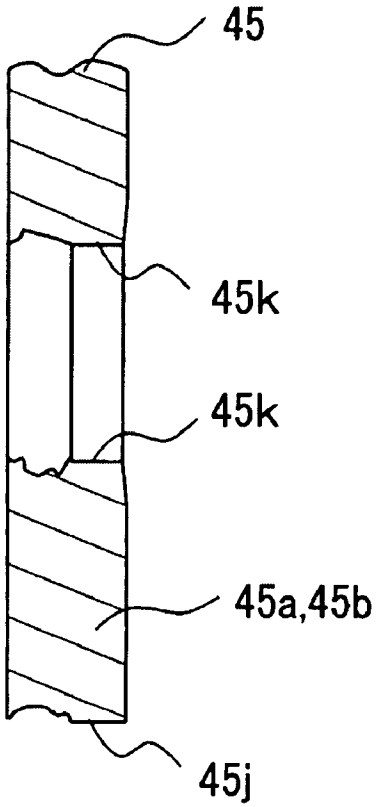
FIG. 5 is a detail view of B portion of FIG. 4.

The sensor wheel 45 is press-molded. A sectional face extending on the rotational axis of the projecting portions 45*a* and 45*b*, and the elongated holes 45*e* and 45*f* includes linear portions 45*j* and 45*k* in parallel with the rotational axis of the projecting portions 45*a* and 45*b*, and the elongated holes 45*e* and 45*f* as shown in FIG. 5. Thus, the wrong detection of the sensor 95 may be prevented. The linear portions 45*j* and 45*k* each may be formed as a shear plane by accurate press molding.

Figure 2:
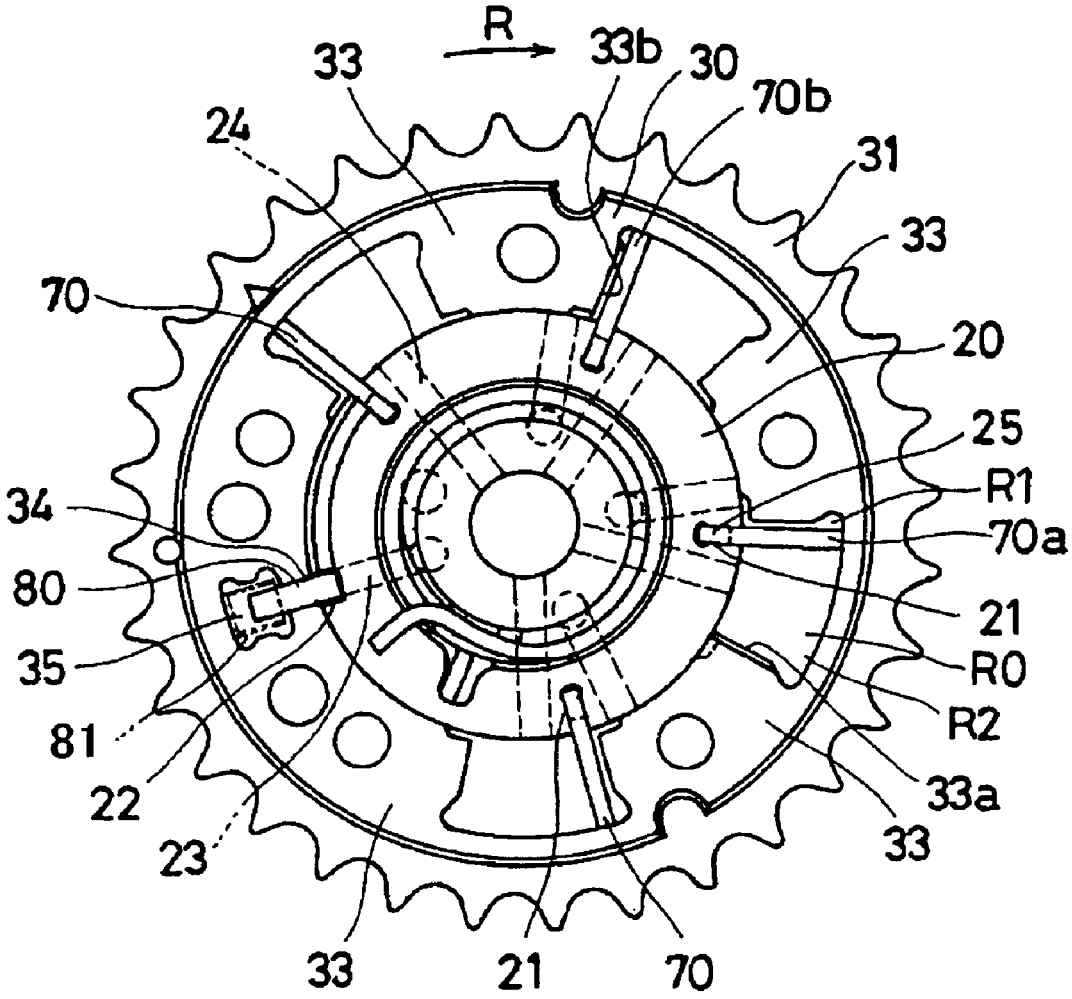
FIG. 2 is a cross-sectional view taken along the line I—I of FIG. 1.

As shown in FIG. 2, four vane grooves 21, a receiving groove 22, and four first fluid passages 23 and four second fluid passages 24 extending in the radial direction of the rotor 20 are formed on the rotor 20. The four vanes 70 are positioned in the vane grooves 21 respectively, being movable in the radial direction of the rotor 20. A leaf spring 25 is disposed between a bottom portion of each vane groove 21 and a bottom face of each vane 70. Each vane 70 is biased in the radially outward direction by the leaf spring 25 and is slidable on the inner circumferential face of the housing 30. In a state shown in FIG. 2, i.e. when a relative phase between the camshaft 10 and the rotor 20, and the housing 30 is positioned at a predetermined phase (i.e. most retarded angle phase), a head portion of a lock key 80 is inserted into the receiving groove 22 by a predetermined amount. The receiving groove 22 is connected to the first fluid passage 23.

The housing 30 is assembled on an outer periphery of the rotor 20, being rotatable relative thereto within a predetermined angle range. The timing sprocket 31 is integrally formed on an outer periphery of the housing 30.

Four convex portions 33 are formed on an inner circumference of the housing 30 in the circumferential direction thereof, projecting in the radially inward direction. Each inner circumferential face of the convex portion 33 is slidably in contact with an outer circumferential face of the rotor 20. That is, the housing 30 is rotatably supported on the rotor 20. A retracting groove 34 for accommodating the lock key 80, and a spring receiving groove 35 connected to the retracting groove 34 for accommodating a spring 81 that biases the lock key 80 in the radially inward direction of the housing 30 are formed on one of the convex portions 33.

Each vane 70 divides a fluid pressure chamber R0 formed between the housing 30 and the rotor 20, and also between the convex portions 33 adjacent to each other in the circumferential direction into the advanced angle chamber R1 and the retarded angle chamber R2. The relative rotation between the rotor 20 and the housing 30 on the most advanced angle side is restricted at a position where the vane 70, i.e. a vane 70*a* in FIG. 2, is in contact with one side face 33*a* of the convex portion 33 in the circumferential direction. Meanwhile, the relative rotation between the rotor 20 and the housing 30 on the most retarded angle side is restricted at a position where the vane 70, i.e. a vane 70*b* in FIG. 2, is in contact with the other side face 33*b* of the convex portion 33 in the circumferential direction. At this time, the head portion of the lock key 80 is positioned in the receiving groove 22 for restricting the relative rotation between the rotor 20 and the housing 30 according to the present embodiment.

According to the above-mentioned embodiment, a desired valve timing may be obtained by controlling the fluid pressure in each advanced angle chamber R1 and retarded angle chamber R2 for controlling the relative rotation of the rotor 20 to the housing 30. At this time, a rotational phase of the sensor wheel 45 integrally rotating with the rotor 20 that is detected by the sensor 95, and a rotational phase of the crankshaft that is detected by a sensor (not shown) provided at a crankshaft portion, are compared for determining whether a desired valve timing has been obtained.

When the internal combustion engine is stopped, the head portion of the lock key 80 is inserted into the receiving groove 22 by a predetermined amount and thus the relative rotation between the rotor 20 and the housing 30 is locked, i.e. restricted at the most retarded angle phase.

After the internal combustion engine is started and the retarded angle phase is required for the valve timing depending on the operation condition of the internal combustion engine, the operation fluid (fluid pressure) supplied from an oil pump (not shown) is provided to the advanced angle chamber R1 by passing through the advanced angle fluid passage 11 and the first fluid passage 23. The operation fluid is also provided to the receiving groove 22 via the passage 23. Meanwhile, the operation fluid stored in the retarded angle chamber R2 is sent to the second fluid passage 24 and the retarded angle fluid passage 12 to be discharged from a switching valve (not shown) to an oil pan (not shown). At this time, the lock key 80 is moved against the biasing force of the spring 81. Then, the head portion of the lock key 80 is retracted from the receiving groove 22 to thereby release the locked state between the rotor 20 and the housing 30. Therefore, the rotor 20 and each vane 70 may be rotated to the advanced angle side R (see FIG. 2) relative to the housing 30.

When the retarded angle phase is required for the valve timing depending on the operation condition of the internal combustion engine, the operation fluid supplied from the oil pump is provided to the retarded angle chamber R2 by passing through the retarded angle fluid passage 12 and the second fluid passage due to the operation of the switching valve. Meanwhile, the operation fluid stored in the advanced angle chamber R1 is sent to the first fluid passage 23 and the advanced angle fluid passage 11 to be discharged from the switching valve to the oil pan. Therefore, the rotor 20 and each vane 70 may be rotated to the retarded angle side relative to the housing 30.

According to the aforementioned embodiment, the sensor wheel 45 includes at least one reference hole 45*g* for determining the position of the projecting portions 45*a* and 45*b* in the circumferential direction. Thus, when the rotor 20 or the housing 30 is assembled to the sensor wheel 45, the position of the sensor wheel 45 in the circumferential direction may be accurately determined by using the reference hole 45*g*, thereby preventing the sensor wheel 45 from being deformed when press fit to the rotor 20. In addition, moment of inertia may be reduced by forming the reference hole 45*g* on the sensor wheel 45. The rotational displacement between the sensor wheel 45 and the rotor 20 due to the torque fluctuation of the cam may be prevented.

In addition, according to the aforementioned embodiment, when the sensor wheel 45 is press fit to the boss portion 20*a* formed on the rotor 20 in the axial direction thereof, the axial end face of the sensor wheel 45 and the axial end face of the boss portion 20*a* are positioned on the identical plane. Thus, the sensor wheel 45 may be press fit to the boss portion 20*a* until the boss portion 20*a* becomes in contact with the face of the fixing jig positioned on the identical plane to the axial end faces of the boss portion 20*a* and the sensor wheel 45. The press fit amount of the sensor wheel 45 into the boss portion 20*a* may be easily controlled.

Further, according to the aforementioned embodiment, the extending portion 45*h* of the sensor wheel 45 press fit to the boss portion 20*a* has a conical shape whose outer circumference is gradually reduced in a direction in which the sensor wheel 45 is extending. Thus, the outer diameter of the extending portion 45*h* of the sensor wheel 45 may be reduced with assuring the press fit length into the boss portion 20*a*. The sensor wheel 45 is prevented from interfering with the housing 30 provided adjacent to the sensor wheel 45, thereby reducing a length of the variable valve timing control device in the axial direction thereof and achieving a downsizing.

Furthermore, according to the aforementioned embodiment, the sensor wheel 45 is press-molded. The sectional face extending on the rotational axis of the projecting portions 45*a* and 45*b* includes the linear portions 45*j* and 45*k* in parallel with the rotational axis, thereby preventing the wrong determination of the sensor.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the sprit of the present invention. Accordingly, it is expressly intended that all such variations, changes and equivalents which fall within the spirit and scope of the present invention as defined in the claims, be embraced thereby.

What is claimed is:

1. A variable valve timing control device comprising:

a rotor member integrally connected to either one of a camshaft and a crankshaft for opening and closing a valve, either one of the camshaft and the crankshaft being rotatably assembled to a cylinder head of an internal combustion engine;

a housing member connected to either one of the crankshaft and the camshaft via a driving force transmitting member and assembled to the rotor member so as to be rotatable relative thereto;

a vane provided on either one of the rotor member and the housing member;

a fluid pressure chamber formed between the rotor member and the housing member and divided into an advanced angle chamber and a retarded angle chamber by the vane; and a sensor wheel assembled to either one of the rotor member and the housing member and including a projecting portion for detecting a rotational angle of the rotor member or the housing member by using a sensor provided adjacent to the sensor wheel; wherein the sensor wheel includes at least one reference hole for determining a position of the projecting portion in a circumferential direction of the sensor wheel.

2. A variable valve timing control device according to claim 1, wherein the sensor wheel is press fit to a boss portion formed on the rotor member in an axial direction thereof, and an axial end face of the sensor wheel and an axial end face of the boss portion are positioned on an identical plane.

3. A variable valve timing control device according to claim 2, wherein the sensor wheel includes an extending portion to be press fit to the boss portion and whose outer circumference is gradually reduced in a direction where the extending portion is extending.

4. A variable valve timing control device according to claim 1, wherein the sensor wheel is press-molded and a sectional face extending on a rotational axis of the projecting portion includes a linear portion in parallel with the rotational axis.

5. A variable valve timing control device according to claim 2, wherein the sensor wheel is press-molded and a sectional face extending on a rotational axis of the projecting portion includes a linear portion in parallel with the rotational axis.

6. A variable valve timing control device according to claim 3, wherein the sensor wheel is press-molded and a sectional face extending on a rotational axis of the projecting portion includes a linear portion in parallel with the rotational axis.

* * * * *